US007895787B1

(12) United States Patent
Andry

(10) Patent No.: US 7,895,787 B1
(45) Date of Patent: Mar. 1, 2011

(54) PORTING FEATURE FOR FIREARM

(76) Inventor: Mark L. Andry, Roebuck, SC (US)

( * ) Notice: Subject to any disclaimer, the term of this patent is extended or adjusted under 35 U.S.C. 154(b) by 519 days.

(21) Appl. No.: 12/008,523

(22) Filed: Jan. 11, 2008

(51) Int. Cl.
*F41A 21/40* (2006.01)

(52) U.S. Cl. ..... 42/79; 89/1.703; 89/14.3

(58) Field of Classification Search ..... 42/79, 1.06; 89/1.703, 14.3, 14.4; D22/108
See application file for complete search history.

(56) References Cited

U.S. PATENT DOCUMENTS

| | | | | | |
|---|---|---|---|---|---|
| 587,801 | A | * | 8/1897 | Durnford et al. | 42/78 |
| 847,911 | A | | 3/1907 | Cory | |
| 1,390,658 | A | | 9/1921 | Towson | |
| 1,598,360 | A | | 8/1926 | Pavek | |
| 1,605,393 | A | | 11/1926 | Cutts, Jr. | |
| 2,088,380 | A | | 7/1937 | Methlin | |
| RE20,958 | E | | 12/1938 | White | |
| 2,165,457 | A | * | 7/1939 | Cutts, Jr. | 89/14.3 |
| 2,192,081 | A | | 2/1940 | Hughes | |
| 2,313,669 | A | | 3/1943 | Reising | |
| 2,442,899 | A | | 6/1948 | McAllister | |
| D158,796 | S | | 5/1950 | Edwards | |
| 2,567,826 | A | | 9/1951 | Prache | |
| 2,589,738 | A | | 3/1952 | Sedberry | |
| 2,662,326 | A | * | 12/1953 | Powell | 42/79 |
| 2,676,429 | A | | 4/1954 | Gotterson | |
| 2,712,193 | A | * | 7/1955 | Mathis | 42/79 |
| 2,759,286 | A | | 8/1956 | Moore | |
| 2,828,569 | A | * | 4/1958 | Steane | 42/79 |
| 2,852,983 | A | | 9/1958 | Netzer | |
| 2,922,242 | A | * | 1/1960 | Pachmayr et al. | 42/79 |
| 3,141,376 | A | * | 7/1964 | Chinn | 89/14.3 |
| 3,161,979 | A | * | 12/1964 | Lowe | 42/79 |
| 3,367,055 | A | | 2/1968 | Powell | |
| 3,427,648 | A | | 2/1969 | Manning | |
| 3,455,203 | A | | 7/1969 | Pillersdorf | |
| 3,492,750 | A | | 2/1970 | Ashbrook et al. | |
| 3,496,667 | A | | 2/1970 | Lowry | |
| 3,676,947 | A | | 7/1972 | Ashbrook | |
| 3,707,899 | A | | 1/1973 | Perrine | |
| 3,714,727 | A | | 2/1973 | Lino | |
| 3,724,376 | A | | 4/1973 | Kordas | |
| 3,769,731 | A | * | 11/1973 | Pachmayr et al. | 42/79 |
| 3,867,778 | A | | 2/1975 | Preda et al. | |
| 4,008,538 | A | | 2/1977 | Center | |
| 4,024,791 | A | * | 5/1977 | Stratman | 89/14.2 |
| 4,071,971 | A | | 2/1978 | Tornas | |
| 4,207,799 | A | | 6/1980 | Tocco | |
| 4,467,546 | A | | 8/1984 | Beretta | |
| 4,545,285 | A | | 10/1985 | McLain | |

(Continued)

OTHER PUBLICATIONS

Product Brochure; Pure Gold Precision Tooled Premium Shotgun Chokes; copyright date unknown; Author Pure Gold; (4 pages).

(Continued)

*Primary Examiner* — Benjamin P Lee
(74) *Attorney, Agent, or Firm* — J. Bennett Mullinax, LLC

(57) ABSTRACT

A choke for use with a shotgun is provided. In accordance with one embodiment the choke has a body that defines a bore with a longitudinal axis therethrough. The body is configured for engagement with a shotgun, and the bore is positioned for traversal of a wad and shot therethrough and out of an end of the bore. The body has a circumference, an inner surface, and outer surface. The body defines at least one port for venting gas from the bore that extends from the inner surface to the outer surface. The shape of the port at the inner surface is asymmetrical.

20 Claims, 5 Drawing Sheets

U.S. PATENT DOCUMENTS

| | | | | |
|---|---|---|---|---|
| 4,570,529 | A | 2/1986 | A'Costa | |
| 4,711,048 | A | 12/1987 | Ashbrook | |
| 4,930,396 | A | 6/1990 | Johnson | |
| 5,092,223 | A | 3/1992 | Hudson | |
| 5,157,211 | A | 10/1992 | Mossberg | |
| 5,225,615 | A | 7/1993 | Talbot et al. | |
| 5,272,827 | A | 12/1993 | Vang | |
| D343,222 | S | 1/1994 | Morales | |
| 5,317,825 | A | 6/1994 | Vatterott | |
| 5,367,940 | A * | 11/1994 | Taylor | 89/14.3 |
| 5,394,633 | A | 3/1995 | Alessandri, Jr. | |
| 5,415,073 | A | 5/1995 | Ciluffo | |
| 5,425,298 | A | 6/1995 | Coburn | |
| 5,452,535 | A * | 9/1995 | See et al. | 42/79 |
| 5,587,549 | A | 12/1996 | Clouse | |
| 5,631,438 | A | 5/1997 | Martel | |
| 5,675,107 | A * | 10/1997 | Ledys et al. | 89/14.3 |
| 5,811,714 | A | 9/1998 | Hull et al. | |
| 5,814,757 | A * | 9/1998 | Buss | 89/14.3 |
| 6,112,447 | A * | 9/2000 | Androsov | 42/79 |
| 6,128,846 | A | 10/2000 | Walker et al. | |
| 6,374,718 | B1 | 4/2002 | Rescigno | |
| 6,557,290 | B2 | 5/2003 | Kumler | |
| 6,604,445 | B2 | 8/2003 | Sevastian | |
| 6,722,254 | B1 | 4/2004 | Davies | |
| 6,752,062 | B2 * | 6/2004 | Vais | 89/14.3 |
| 6,782,651 | B1 | 8/2004 | Walker et al. | |
| 6,789,343 | B1 | 9/2004 | Dietrich | |
| 6,820,530 | B2 * | 11/2004 | Vais | 89/14.3 |
| 6,889,593 | B2 * | 5/2005 | Guhring et al. | 89/14.5 |
| 6,990,764 | B2 | 1/2006 | Walker | |
| 7,032,339 | B1 * | 4/2006 | Bounds | 42/1.06 |
| 7,059,235 | B2 | 6/2006 | Hanslick et al. | |
| 7,140,140 | B2 * | 11/2006 | Yoshitaka | 42/79 |
| 7,296,505 | B2 * | 11/2007 | Balbo et al. | 89/14.3 |
| 7,328,645 | B1 | 2/2008 | Curry et al. | |
| 7,523,581 | B1 * | 4/2009 | Leutenegger et al. | 42/79 |
| 2002/0117048 | A1 | 8/2002 | Sevastian | |
| 2002/0121040 | A1 | 9/2002 | Kumler | |
| 2002/0129533 | A1 | 9/2002 | Hengstenberg | |
| 2003/0106416 | A1 * | 6/2003 | Vais | 89/14.3 |
| 2004/0154209 | A1 | 8/2004 | Walker | |
| 2004/0244571 | A1 * | 12/2004 | Bender | 89/14.3 |
| 2005/0011102 | A1 | 1/2005 | Boyer | |
| 2005/0066803 | A1 | 3/2005 | Rosenthal | |
| 2005/0066804 | A1 * | 3/2005 | Guhring et al. | 89/14.05 |
| 2005/0188829 | A1 | 9/2005 | Hanslick et al. | |
| 2006/0010750 | A1 | 1/2006 | Yoshitaka | |
| 2006/0048639 | A1 | 3/2006 | Felton | |
| 2006/0060075 | A1 | 3/2006 | Zeineh | |
| 2008/0173166 | A1 * | 7/2008 | Andry | 89/14.3 |

OTHER PUBLICATIONS

Product Catalog; Mag-na-port International, Inc. Product Catalog; coyright date unknown; Author Mag-na-port International, Inc.; (9 pages).

U.S. Appl. No. 11/656,618, filed Jan. 23, 2007; titled "Shotgun Choke"; inventor Mark L. Andry; (27 pages).

* cited by examiner

PORTING FEATURE FOR FIREARM

FIELD OF THE INVENTION

The present invention relates generally to firearms. More particularly, the present application involves a port that can function to expel gas during discharge of a firearm.

BACKGROUND

Firearms can be provided with various features to improve their performance. For example, it is known to employ ports that function to expel combustion gases out of the bore of a barrel of the firearm during discharge. The combustion gases are expelled radially from the bore through the ports so that energy associated with the expelled combustion gases does not contribute to recoil of the firearm. Additionally, porting of combustion gases from the barrel acts to dissipate heat generated during firing and prevents temperature elevation of the firearm after multiple shots are fired.

Additional features that can be incorporated into firearms include knife edges that are arranged longitudinally along the interior of the barrel that act to score a wad as it passes through the bore. The wad may house a plurality of pellets or flechettes. Scoring of the wad by the knife edges may facilitate its rapid opening upon exiting the barrel so that the wad does not interfere with the string of pellets as they travel to their target.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
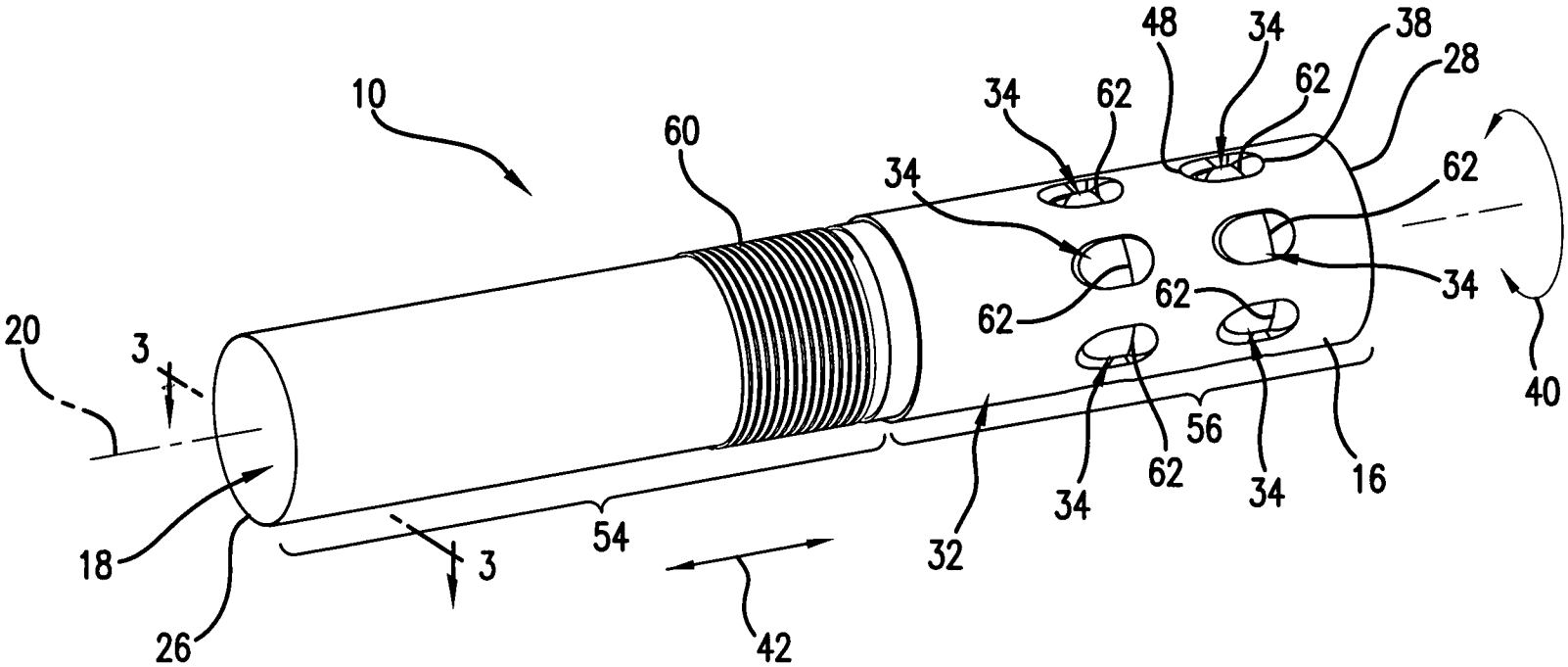
FIG. 1 is a perspective view of a choke with a port in accordance with one exemplary embodiment.

Repeat use of reference characters in the present specification and drawings is intended to represent the same or analogous features or elements of the invention.

DETAILED DESCRIPTION OF THE DRAWINGS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a port 34 for use with a firearm 12 that allows firing gas to be expelled from a bore 18 of the firearm 12 during discharge. The port 34 may also be arranged to form a knife edge 62 that functions to more easily strip a wad 22 during discharge. For example, the port 34 may function to assist in stripping a wad 22 so that the wad 22 opens rapidly upon exiting the bore 18 so as not to interfere with a string of shot 24 as they travel to their target. A method of forming a port 34 to aid in the stripping of a wad 22 is also disclosed.

FIG. 1 is a perspective view of a choke 10 in accordance with one exemplary embodiment. The choke 10 can be attached to a firearm 12 to afford a tapered portion through which a wad 22 and shot 24 can travel. When used in conjunction with a firearm 12 that is a shotgun, the choke 10 acts to force the shot 24 into a tighter stream upon exiting. Various chokes 10 can be placed onto the firearm 12 in order to achieve a desired shot pattern for a particular purpose. A plurality of ports 34 are defined in the choke 10. The ports 34 act to reduce recoil force as gas 36 generated during firing of the wad 22 and shot 24 is vented through the radially disposed ports 34. Additionally, the ports 34 are arranged so as to provide a knife edge 62 that aids in the stripping of a wad 22 so that the wad 22 is hindered in interfering with a shot 24 pattern.

The choke 10 is releasably attachable to the firearm 12 through a threaded engagement. As shown, choke 10 includes external threading 60 that engages internal threading present on an interior passage of the firearm 12. The choke 10 can be attached to and removed from the firearm 12 by the user as desired. A different choke 10 that includes different features may be subsequently attached to the firearm 12 to result in a desired shot pattern or to achieve some other desired benefit. Although described as being releasably attachable, the choke 10 may be permanently attached to the firearm 12 in accordance with various exemplary embodiments. Additionally, the choke 10 can be integrally formed with the firearm 12 or may be a separate component that is either permanently or releasably attached to the firearm 12 in accordance with other embodiments. Although described as being attached through the use of external threading 60, the choke 10 can be attached to the firearm 12 through various means such as clips, welding, a snap-fit engagement, screws, or various types of mechanical fasteners.

The choke 10 includes a body 16 that defines a bore 18 therethrough. Bore 18 has a longitudinal axis 20 that may be coaxial with a longitudinal axis of the firearm 12 when the choke 10 is attached. The bore 18 extends from one open end 26 to an opposite open end 28. Open end 26 receives wad 22 and shot 24 traveling from the other portions of the firearm 12. The wad 22 and shot 24 are subsequently expelled from the choke 10 through open end 28 of bore 18 to exit the firearm 12. Choke 10 can be made of a strong material such as high-hardness stainless steel in order to resist deformation due to explosive forces and elevated temperatures that result upon firing a wad 22 and shot 24 therethrough.

Figure 2:
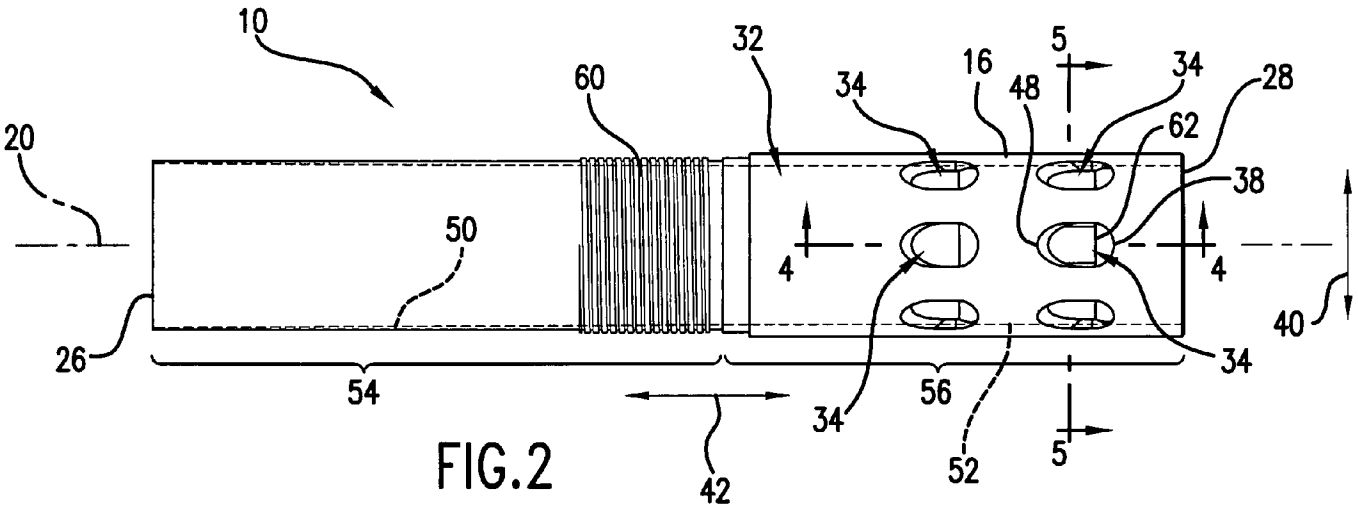
FIG. 2 is a top view of the choke of FIG. 1.

Referring now to FIG. 2, body 16 has a mounting segment 54 and a choking segment 56. The mounting segment 54 and choking segment 56 are located next to one another in the longitudinal direction 42 of body 16. As shown, the mounting segment 54 is located proximal to the choking segment 56 in the longitudinal direction 42. Open end 26 of bore 18 opens into the mounting segment 54 which also includes the external threading 60. The choking segment 56 includes open end 28 of bore 18 along with one or more ports 34. Bore 18 does not have a consistent diameter extending all the way from end 26 to end 28. Instead, a conical section 50 of bore 18 is present in the mounting segment 54. Bore 18 has a larger diameter at end 26 which tapers to a smaller diameter at the location in which mounting segment 54 contacts choking segment 56. In effect, the conical section 50 of bore 18 narrows as the wad 22 and shot 24 traverse therethrough. Conical section 50 functions to constrict the wad 22 and shot 24 and thus causes certain desired effects to be achieved. Bore 18 has a parallel section 52 in choking segment 56. Bore 18 has a constant diameter through the parallel section 52 from the point of contact between the choking segment 56 and mounting segment 54 until the end 28 of bore 18. In this regard, the inner surface 30 of the body 16 at the choking segment 56 has a constant inner diameter. Parallel section 52 of bore 18 may also function to impart a constriction onto the wad 22 and shot 24 traveling therethrough to achieve certain desired effects.

The shape and length of conical section 50 and parallel section 52 can be varied in order to achieve various results. For example, a steep taper angle of the conical section 50 will cause shot 24 to quickly compress which may result in a larger shot pattern spread. A flatter taper angle of conical section 50 will cause the shot 24 to compress more gradually and may result in a tighter and more consistent shot pattern. The length of the parallel section 52 in the longitudinal direction 42 of body 16 may also effect the resulting shot 24 pattern. For example, a larger length of parallel section 52 may cause a more uniform shot column to develop which can create consistently tighter shot patterns. A shorter length in the longitudinal direction 42 of parallel section 52 may cause a larger shot pattern to be produced from parallel section 52. Further, the use of a longer parallel section 52 may increase the benefits realized by the presence of ports 34. As stated, ports 34 cause firing gas 36 to be released which in turn acts to slow down the speed of the wad 22 and shot 24 upon traversing bore 18. In some instances, the presence of ports 34 function to slow the speed of a wad 22 which may be prevent the wad 22 from breaking up a column of shot or pellets 24. Allowing the shot 24 to develop into a column without interference of wad 22 can result in a more desirably consistent shot pattern. Modification of the length of parallel section 52 acts to modify the effectiveness of the ports 34 and thus effects the resulting shot pattern.

Although described as having both a conical section 50 and a parallel section 52, it is to be understood that bore 18 can be variously configured in accordance with other exemplary embodiments. For example, the bore 18 may have a constant diameter from one end 26 to the other end 28. In this regard, the bore 18 is parallel throughout. Alternatively, the bore 18 may be conical from end 26 to end 28. Here, the bore 18 may be larger at end 26 and smaller in diameter at end 28. Further, the diameter of bore 18 may be varied in accordance with various exemplary embodiments to modify the size of the resulting shot patterns. Although described as having a mounting segment 54 and choking segment 56, it is to be understood that the wad 22 and shot 24 can be restricted or choked in either one of or both of these segments 54 or 56.

The choke 10 as shown with reference to FIGS. 1 and 2 has a circumference that has a curved shape. However, it is to be understood that other exemplary embodiments exist in which the circumference need not be curved in shape. For example, the circumference of the body 16 can have one or more flat sections in the mounting segment 54 or choking segment 56 of body 16. The ports 34 are shown located in the choking segment 56 of the body 16, but can be located in the mounting segment 54 in addition to or alternatively to the choking segment 56 in accordance with other exemplary embodiments. The ports 34 are located around the entire circumference of the body 16 and may be radially symmetrical about the body 16. However, the ports 34 need not be radially symmetrical in accordance with other exemplary embodiments.

Figure 3:
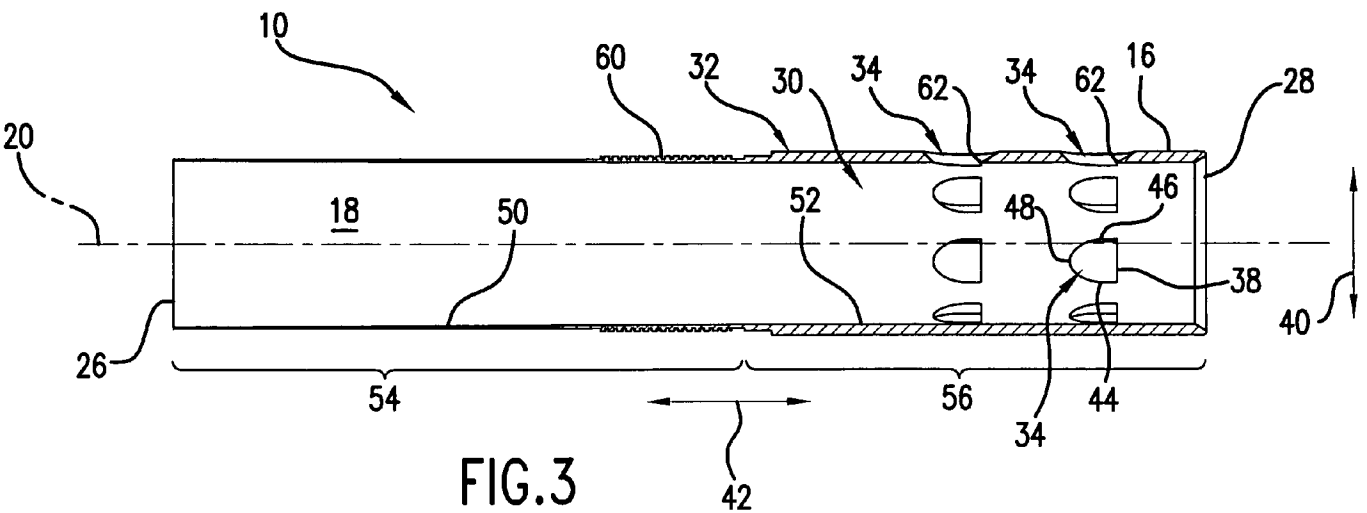
FIG. 3 is a cross-sectional view taken along line 3-3 of FIG. 1.

Referring now to FIG. 3, a cross-sectional view taken along line 3-3 of FIG. 1 is shown. The arrangement of the ports 34 at the inner surface 30 of the body 16 is displayed. Port 34 has a distal end 38 at the inner surface 30 that extends in the radial direction 40 of the body 16 but does not extend in the longitudinal direction 42 of the body 16. As such, the distal end 38 of the port 34 at the inner surface 30 may be perpendicular to the longitudinal axis 20 and may be perpendicular to the direction of travel of the wad 22 and shot 24 through the bore 18. The port 34 has a side 44 and a side 46 at the inner surface 30 that extend in the longitudinal direction 42 of the body 16 but do not extend in the radial direction 40 of the body 16. The sides 44 and 46 are parallel with one another at the inner surface 30 and are each contiguous with the distal end 38 at the inner surface 30.

The port 34 also has a proximal end 48 at the inner surface 30 that extends both in the radial direction 40 and in the longitudinal direction 42. The proximal end 48 of the port 34 is contiguous with the sides 44 and 46 at the inner surface 30. The proximal end 48 at the inner surface 30 may be described as being curved with a radial component. The port 34 is thus completely defined at the inner surface 30 by the distal end 38, side 44, side 46, and proximal end 48. As shown, the port 34 is asymmetrical in shape at the inner surface 30.

However, it is to be understood that other arrangements are possible in which the port 34 is not asymmetrical in shape at the inner surface 30. For example, the port 34 may be configured as shown in FIG. 3 with the exception of the proximal end 48 that may be arranged in a manner similar to the distal end 38. In these embodiments, the port 34 may be symmetrical in shape. As shown in FIG. 3, the port 34 may be described as having an elliptical shape at the inner surface 30 with a flattened distal end.

Figure 6:
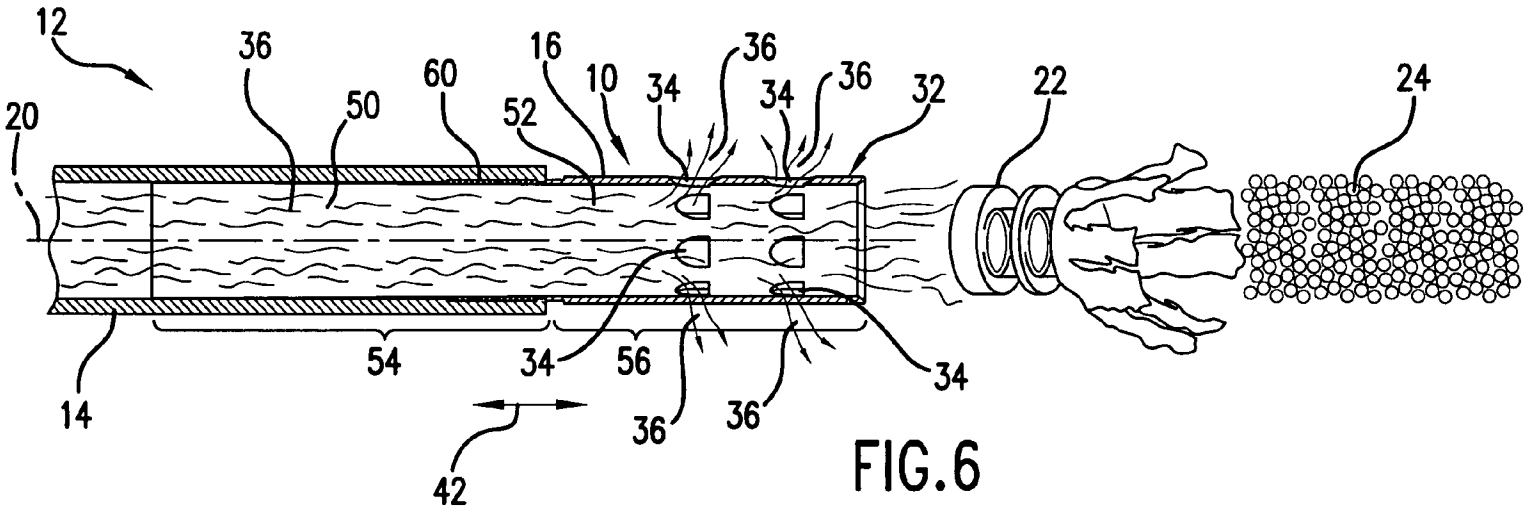
FIG. 6 is a cross-sectional view of the choke of FIG. 1 when used during the discharge of a firearm.

The port 34 functions to expel firing gas 36 from the bore 18 so that the resulting recoil due to discharge of the firearm 12 is reduced. Additionally, the port 34 is arranged so that the distal end 38 functions to aid in stripping of wad 22. In this regard, the orientation of the distal end 38 of port 34 may create friction that slows down an outer portion of the wad 22 traversing across the port 34 to prevent interference. FIG. 6 shows one exemplary embodiment in which a firearm 12 is discharged that includes a wad 22 and shot 24. The shot 24 may escape the wad 22 upon exiting end 28 or shortly thereafter. The wad 22 is slowed upon crossing the distal ends 38 of the ports 34 so that it does not interfere with the shot 24 to thus allow the shot 24 to more accurately hit its target. Although not wishing to be bound by a particular theory of operation, the distal ends 38 may also function to score the wad 22 so that the wad is weakened and thus more easily opens upon exiting the bore 18 to thus minimize interference with the shot 24 string. The firing gas 36 that pushes the wad 22 and shot 24 through the choke 10 is at least partially vented through the ports 34 once the wad 22 and shot 24 have passed the ports 34 to allow sufficient space for venting. Ports 34 are arranged so as to vent some of the firing gas 36 in a direction different than that of the direction of force of the wad 22 and shot 24.

The ports 34 may be sized so as to have a fairly large length in the radial direction. Use of larger ports 34 may more easily allow portions of the wad 22 to be pulled into the ports 34 when traversing across the ports 34. Although not wishing to be bound by any theory of operation, a vacuum may be formed that acts to pull the surface of the wad 22 into the port 34, or combustion gases inside of the bore 18 may force the wad 22 against the inner surface 30 and hence inside of the ports 34 when traversing across ports 34. As the wad 22 is pulled slightly inside of the ports 34 or at least tightly against the inner surface 30 during traversal, the wad 22 will eventually contact the distal end 38 so that the knife edge 62 can more effectively engage and distort the wad 22 as it passes. However, it is to be understood that other arrangements are possible in which the wad 22 is not slightly pulled into the ports 34 or even held tightly against the inner surface 30 upon discharge of the firearm 12. As such, various exemplary embodiments are possibly in which the ports 34 are generally small in the radial direction 40 and do not function to easily allow the wad 22 to enter the port 34 to more easily facilitate stripping by the knife edge 62.

Figure 8:
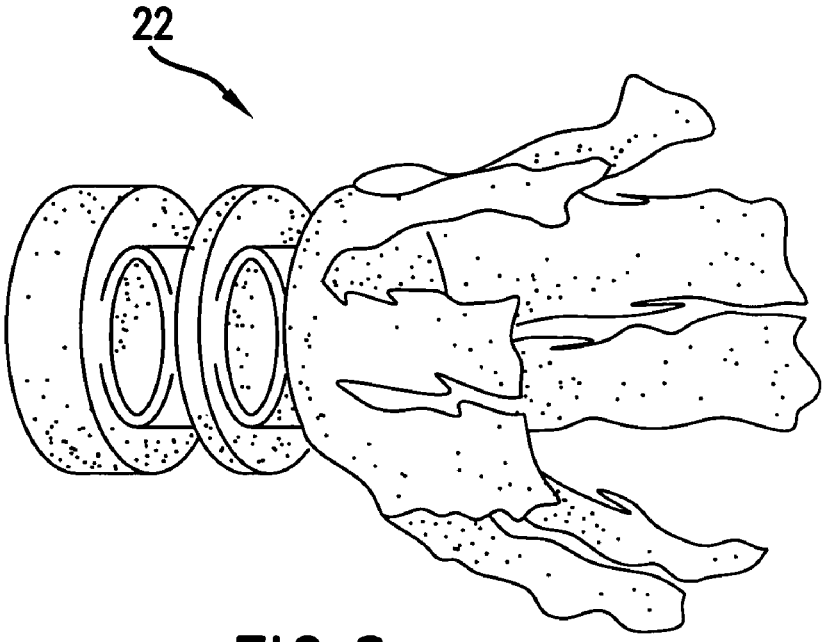
FIG. 8 is a side view of a wad stripped through use of a port forming a knife edge in accordance with one exemplary embodiment.

FIG. 8 is a side view of the wad 22 upon discharge in accordance with one exemplary embodiment. As illustrated, the knife edge 62 has significantly distorted the wad 22 to the point that it is more significantly damaged than the wad 22 illustrated in FIG. 9. The wad 22 shown in FIG. 9 was produced by through discharge of a firearm 12 that does not include the port 34 and associated knife edge 62 as presently discussed. Comparison of the two wads 22 illustrates the significant distortion imparted by the knife edge 62 which results in a wad 22 that is more easily opened upon exiting the bore 18 and more significantly slowed during traversal through the bore 18. The wad 22 associated with the knife edge 62 interferes less with string of shot 24 produced upon discharge. The wad 22 used in conjunction with the firearm 12 that does not have the port 34 and associated knife edge 62 is less distorted upon discharge and may not be as slowed upon traversal such that a greater interference with the string of shot 24 is realized.

Figure 9:
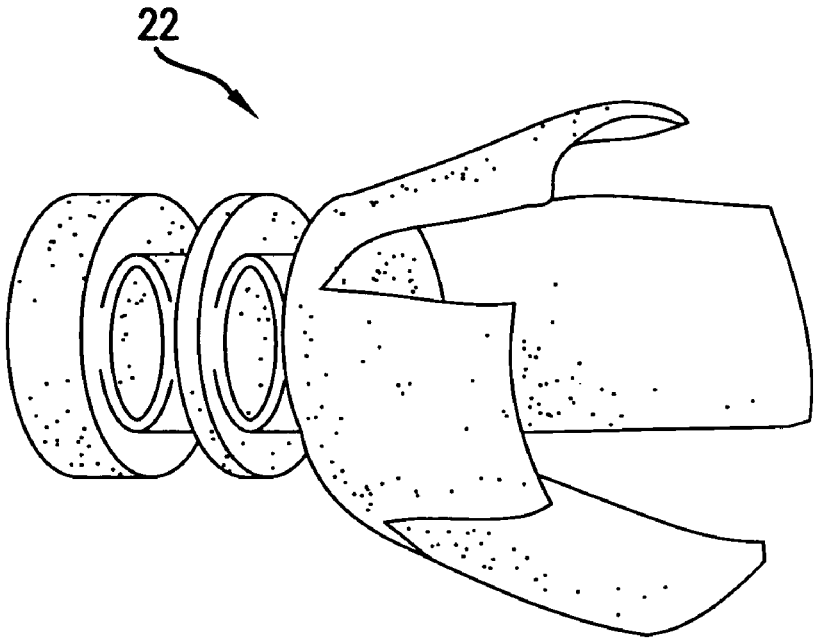
FIG. 9 is a side view of a wad stripped through use of a ported choke.

Although an aforementioned comparison has been made between wads 22 it is to be understood that the distortion of the wad 22 illustrated in FIGS. 8 and 9 are only exemplary. As such, certain exemplary embodiments are possible in which the wad 22 is distorted exactly or substantially like that shown in FIG. 9. Further exemplary embodiments exist in which the wad 22 is not distorted as that illustrated in FIG. 8.

Figure 4:
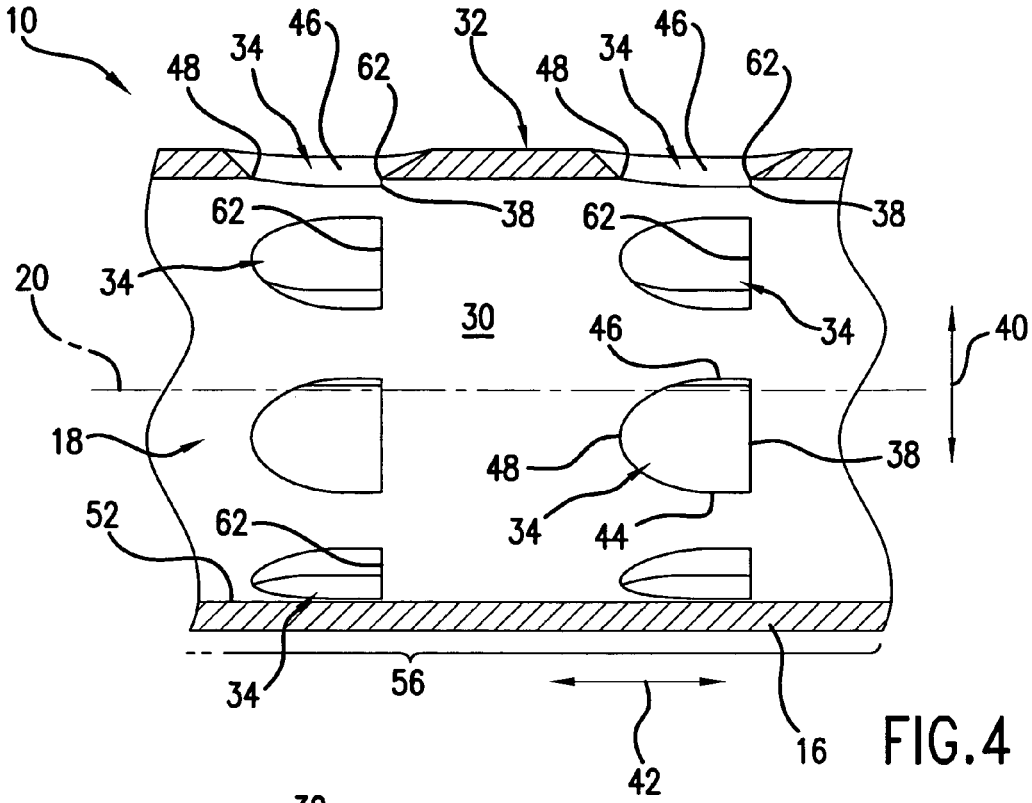
FIG. 4 is a cross-sectional view taken along line 4-4 of FIG. 2.

FIG. 4 shows a cross-section of the choke 10 along lines 4-4 of FIG. 2. The port 34 extends from the inner surface 30 to the outer surface 32 of the body 16. The port 34 increases in size from the inner surface 30 to the outer surface 32 such that the port 34 is larger at the outer surface 32 than at the inner surface 30. In this regard, the sides 44 and 46 remain a constant size from the inner surface 30 to the outer surface 32, but the distal end 38 and the proximal end 48 both increase in size from the inner surface 30 to the outer surface 32. However, it is to be understood that other configurations of the port 34 are possible. For example, side 44 and/or side 46 may increase or decrease in size from the inner surface 30 to the outer surface 32. Further, the proximal end 48 may decrease in size or remain the same size from the inner surface 30 to the outer surface 32. The distal end 38 may form a knife edge 62 upon extending from the inner surface 30 to the outer surface 32. The knife edge 62 can additionally function to slow a portion of the wad 22 passing across. The knife edge 62 may extend from the inner surface 30 to the outer surface 32 at any angle with respect to the longitudinal axis 20. For example, the knife edge 62 may extend at an angle from 30° to 60° to the longitudinal axis 20 from the inner surface 30 to the outer surface 32 in accordance with various exemplary embodiments. The knife edge 62 may act to cut or otherwise scar the wad 22 as it traverses across the knife edge 62. Damage of a portion of the wad 22, such as the petals of the wad 22, causes it to weaken and thus more easily open or expand once it is no longer contained against the inner surface 30 of the bore 18. The knife edge 62 can be arranged in a number of manners in accordance with various exemplary embodiments. Increasing the size of the port 34 in the radial direction 40 may act to increase the surface area of the knife edge 62 so as to more effectively strip a portion of the wad 22.

As shown in FIG. 4, the distal end 38 at the outer surface 32 is located distal to the distal end 38 at the inner surface 30. The proximal end 48 at the outer surface 32 is located proximal to the proximal end 48 at the inner surface 30. Other arrangements are possible. For example, the proximal end 48 at the outer surface 32 may be distally located to the proximal end 48 at the inner surface 30. As used herein, the terms distal and proximal refer to relative positions with respect to the longitudinal axis 20. Proximal refers to a location generally closer to the user of the firearm 12, and distal refers to a location generally farther from the user of the firearm 12 when using the firearm 12. Likewise, the wad 22 and shot 24 travel from the proximal to the distal direction when traversing the choke 10. With reference to FIG. 2, the port 34 is asymmetrical at the outer surface 32. In this regard, the port 34 at the outer surface 32 is generally elliptical with a distal end that is flattened. However, other arrangements are possible in which the port 34 has a symmetrical shape at the outer surface 32.

Figure 5:
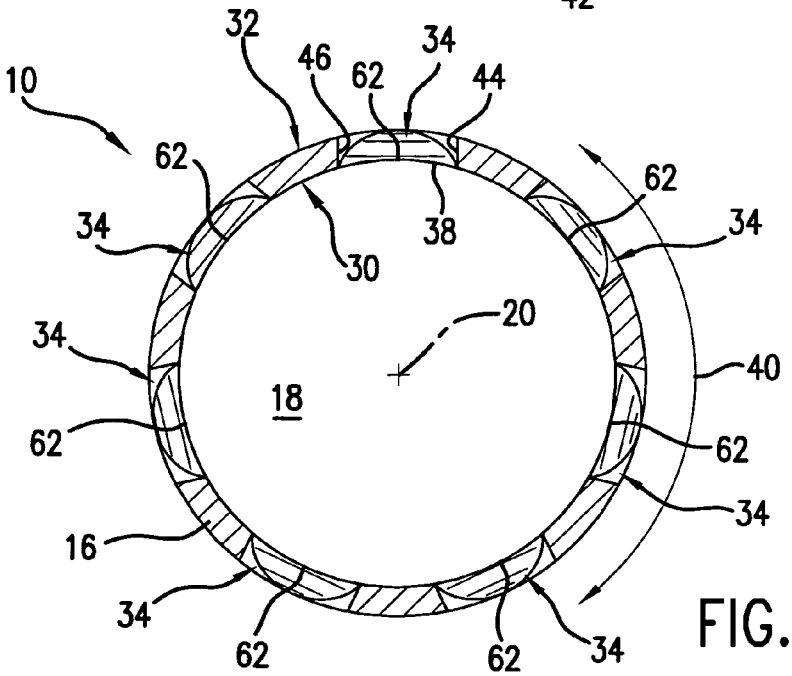
FIG. 5 is a cross-sectional view taken along line 5-5 of FIG. 2.

FIG. 5 shows a cross-sectional view along line 5-5 of FIG. 2. As shown, a plurality of ports 34 extend about the circumference of the body 16. Any number of ports 34 can be used in accordance with various exemplary embodiments. For example, fourteen ports 34 can be used in accordance with one embodiment in which the ports 34 are divided into two sets of seven. The first set is located distal to the second set, and the ports 34 are arranged so as to be radially symmetrical about the body 16. However, it is to be understood that any number of ports 34 can be employed in accordance with various exemplary embodiments. For example, up to thirty ports 34 can be used in certain embodiments. In accordance with one exemplary embodiment, a single port 34 can be present. Further, when using a number of ports 34, they can be positioned in a non-symmetrical manner about the body 16.

Figure 7:
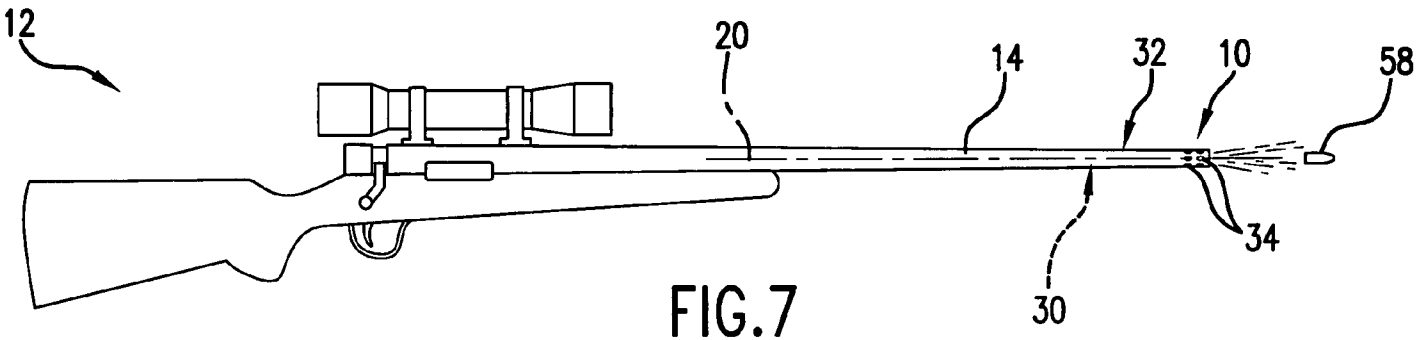
FIG. 7 is a front view of a rifle with a plurality of ports defined in the barrel in accordance with another exemplary embodiment.

Although described as being incorporated into a choke 10, the port 34 need not be located in a choke 10 in accordance with other exemplary embodiments. For example, as shown in FIG. 7, the port 34 can be formed directly into the barrel 14 of a firearm 12 that in this embodiment is a rifle. The rifle is capable of discharging a projectile 58 that in this case is a bullet. The port 34 may be arranged in the same manners are previously discussed. Additionally, the barrel 14 may include the same features as the choke 10 as previously discussed. In this regard, the barrel 14 may have a curved inner surface 30 and a curved outer surface 32. Further, the barrel 14 may have a body 16, bore 18 and a longitudinal axis 20. The barrel 14 may include a choke 10 in accordance with certain exemplary embodiments. In this regard, the ports 34 may be located in either the choke 10 portion of the barrel 14 and/or in another portion of the barrel 14 that does not include the choke 10 portion. A's such, it is to be understood that as used herein the barrel 14 may or may not include a choke 10 that is releasably attachable to the barrel 14. It is to be thus understood that the choke 10 is a part of the barrel 14 in accordance with certain exemplary embodiments. The portions of the barrel 14 that include the choke 10 portion and that do not include the choke 10 portion may be arranged as previously discussed. The firearm 12 can be a shotgun, a rifle, or a pistol in accordance with various exemplary embodiments.

The ports 34 need not be incorporated into a firearm 12 that has a feature that functions to constrict the object traversing therethrough. When used in conjunction with a rifle or a pistol, the ports 34 may act to facilitate the stripping of a sabot from the projectile 58 at the muzzle of the firearm. Additionally, the ports 34 will act to reduce recoil of the firearm 12 upon discharge due to venting of the firing gases 36. The ports 34 can be arranged about the circumference of the body 16 so that a greater amount of firing gases 36 are expelled from the upper portion of the body 16 than the lower portion of the body 16 in order to reduce upward kick of the firearm 12 upon discharge.

The ports 34 can be formed by a number of processes. For example, the ports 34 can be formed by a milling process, a drilling process, or by electrical discharge machining. The port 34 can be formed by removing a portion of the body 16 first at the outer surface 32 and then subsequently removing material down to the inner surface 30. The removal of material, or the cuts, may proceed from the proximal to the distal direction. In this regard, should a milling process be employed, the cutting instrument may be oriented at an angle to the outer surface 32 in the longitudinal direction 42. The cuts made to form the ports 34 may proceed such that the cut is not all the way through the body 16 from the outer surface 32 to the inner surface 30. In this regard, the cutting "stops" before removing all of the material near the distal end 38 to leave the port 34 in the shape that may be seen, for instance, in FIG. 4. Should the cutting instrument proceed all the way through to the inner surface 30, the resulting port would be of the same size on the inner surface 30 as on the outer surface 32 and would be symmetrical in shape at both the inner and outer surfaces 30 and 32. In accordance with one exemplary embodiment, the port 34 is formed by removing material from the outer surface 32 to the inner surface 30 from the proximal to distal direction. Other methods of manufacture are possible in order to form a port 34 that is asymmetrical at the inner surface 30. Asymmetry of the port 34 at the inner surface 30 may be capable of facilitating removal of one portion of the wad 22 from a different portion of the wad 22. In accordance with one exemplary embodiment, the port 34 at the inner surface 30 may be symmetrical with regard to a longitudinally oriented axis running through its center, yet asymmetrical with regard to a radially oriented axis running through its center. Here, although the port 34 at the inner surface 30 may be symmetrical in accordance with one axis, it is asymmetrical with respect to a second axis and is in effect an asymmetrical in shape.

In accordance with certain exemplary embodiments, apertures through the body 16 may be present that do not function to vent gas 36. For example, a choke 10 may be present with a hole located through the mounting segment 54. The hole can be used to help hold the mounting segment 54 to a firearm 12 with an associated pin or bolt, in accordance with certain embodiments. The ports 34 that vent gas 36 need not be configured in a similar manner. In this regard, one or more of the ports 34 may have a distal end 38 at the inner surface 30 that extends in the radial direction 40 but not the longitudinal direction 42 while other ports 34 in the body 16 have distal ends 38 that do extend in the longitudinal direction 42.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A choke for use with a shotgun, comprising:

a body defining a bore with a longitudinal axis therethrough, wherein the body has a longitudinal direction with respect to the longitudinal axis that extends in a distal direction and a proximal direction, wherein the distal direction of the longitudinal direction extends away from the user of the choke when using the shotgun, wherein the proximal direction of the longitudinal direction extends towards the user of the choke when using the shotgun, the body configured for engagement with a shotgun such that the bore is positioned for traversal of a wad and shot therethrough in the distal direction and out of an end of the bore, wherein the body has a circumference, wherein the body has an inner surface and an outer surface, wherein the body defines at least one port for venting gas from the bore that extends from the inner surface of the body to the outer surface of the body, wherein the shape of the port at the inner surface of the body is asymmetrical, wherein the port has a distal end that extends from the inner surface of the body to the outer surface of the body such that the distal end of the port at the outer surface of the body is located further in the distal direction from the user than the distal end of the port at the inner surface of the body such that the port extends in the distal direction from the distal end of the port at the inner surface of the body so as to form a knife-edge that scores the wad as it travels past the knife-edge in the distal direction.

2. The choke as set forth in claim 1, wherein the shape of the port at the outer surface of the body is asymmetrical.

3. The choke as set forth in claim 1, wherein the circumference of the body is curved in shape, and wherein the port has a distal end at the inner surface of the body that extends in a circumferential direction of the body but does not extend in a longitudinal direction of the body.

4. The choke as set forth in claim 3, wherein the port has a pair of sides at the inner surface of the body that extend in the longitudinal direction of the body but do not extend in the circumferential direction of the body, and wherein the port has a proximal end at the inner surface of the body that is curved such that the proximal end extends in the longitudinal direction of the body and extends in the circumferential direction of the body.

5. The choke as set forth in claim 1, wherein the bore of the body has a conical section and a parallel section, wherein the parallel section is configured for receipt of the wad and shot from the conical section and for traversal of the wad and shot therethrough and out of the end of the bore, wherein the inner surface of the conical section of the body tapers towards the longitudinal axis in the proximal to distal direction of the body, and wherein the inner surface of the parallel section of the body maintains a fixed distance from the longitudinal axis from the proximal to distal direction of the body.

6. The choke as set forth in claim 1, wherein the body has a mounting segment and a choking segment positioned next to one another in the longitudinal direction of the body, wherein the circumference of the mounting segment has a curved shape, and wherein the circumference of the choking segment has a curved shape with an outer diameter that is greater than the outer diameter of the circumference of the mounting segment.

7. The choke as set forth in claim 1, wherein the port extends from the inner surface of the body to the outer surface of the body such that the port is smaller at the inner surface of the body than at the outer surface of the body.

8. The choke as set forth in claim 1, wherein a plurality of the ports for venting gas from the bore are present, and wherein the ports are positioned so as to be radially symmetrical about the body.

9. The choke as set forth in claim 1, wherein the distal end of the port at the inner surface of the body extends in a circumferential direction of the body but does not extend in a longitudinal direction of the body, wherein the proximal end of the port extends from the inner surface of the body to the outer surface of the body such that the proximal end of the port at the inner surface of the body is located distal to the proximal end of the port at the outer surface of the body, wherein the proximal end of the port is curved at the inner surface of the body such that the proximal end of the port extends in the longitudinal direction of the body and extends in the circumferential direction of the body.

10. A firearm, comprising:

a barrel that defines a port for use in venting gas from the barrel during firing of the firearm, wherein the barrel has a longitudinal direction that extends in a distal direction and a proximal direction, wherein the distal direction of the longitudinal direction extends away from the user of the firearm when using the firearm, wherein the proximal direction of the longitudinal direction extends towards the user of the firearm when using the firearm, wherein the port extends from an inner surface of the barrel to an outer surface of the barrel, wherein the inner surface and the outer surface of the barrel are generally curved in shape, and wherein a distal end of the port at the inner surface of the barrel extends in a circumferential direction of the barrel but does not extend in the longitudinal direction of the barrel, wherein the distal end of the port extends from the inner surface of the barrel to the outer surface of the barrel such that the distal end of the port at the outer surface of the barrel is located further in the distal direction from the user than the distal end of the port at the inner surface of the barrel such that the port extends in the distal direction from the distal end of the port at the inner surface of the barrel so as to form a knife-edge that scores a projectile during firing of the firearm.

11. The firearm as set forth in claim 10, wherein the barrel has a releasable choke portion, wherein the port is located in the releasable choke portion of the barrel.

12. The firearm as set forth in claim 10, wherein the port has a pair of sides at the inner surface of the barrel that each extend in the longitudinal direction of the barrel but do not extend in the circumferential direction of the barrel, and wherein the port has a proximal end at the inner surface of the barrel that extends in both the longitudinal direction of the barrel and the circumferential direction of the barrel, wherein the port at the inner surface of the barrel is continuous about the distal end of the port, the proximal end of the port, and the two sides of the port.

13. The firearm as set forth in claim 10, wherein a proximal end of the port extends from the inner surface of the barrel to the outer surface of the barrel such that the proximal end of the port at the inner surface of the body is located distal to the proximal end of the port at the outer surface of the barrel, wherein the port is smaller at the inner surface of the barrel than at the outer surface of the barrel.

14. The firearm as set forth in claim 10, wherein the firearm is selected from the group consisting of a shotgun, a rifle, and a pistol.

15. A method of forming a port for use in venting gas when discharging a firearm, comprising the steps of:

providing a barrel that defines a bore that has a longitudinal axis, wherein the barrel has a curved outer surface and a curved inner surface, wherein the barrel has a longitudinal direction with respect to the longitudinal axis that extends in a distal direction and a proximal direction, wherein the distal direction of the longitudinal direction extends away from the user of the firearm when using the firearm, wherein the proximal direction of the longitudinal direction extends towards the user of the firearm when using the firearm; and cutting a port into the barrel such that the cutting proceeds in the proximal to distal direction of the barrel from the outer surface to the inner surface, wherein the port has a distal end that extends from the inner surface of the barrel to the outer surface of the barrel such that the distal end of the port at the outer surface of the barrel is located further in the distal direction from the user than the distal end of the port at the inner surface of the barrel such that the port extends in the distal direction from the distal end of the port at the inner surface of the barrel, wherein the distal end of the port at the inner surface of the barrel extends in a circumferential direction of the barrel but does not extend in either the distal or proximal directions so as to form a knife-edge that scores a projectile during discharging of the firearm.

16. The method as set forth in claim 15, wherein the cutting is performed by milling.

17. The method as set forth in claim 15, wherein the barrel is a choke that is configured for releasable attachment to a firearm.

18. The method as set forth in claim 15, wherein the step of cutting stops at a point such that the port has a pair of sides at the inner surface of the barrel that each extend in the longitudinal direction of the barrel but do not extend in the circumferential direction of the barrel, and such that the port has a proximal end at the inner surface of the barrel that extends in both the longitudinal direction of the barrel and the circumferential direction of the barrel.

19. The method as set forth in claim 15, wherein the cutting step stops at a point such that the resulting port is smaller at the inner surface of the barrel than at the outer surface of the barrel.

20. The method as set forth in claim 15, further comprising the step of cutting a plurality of ports into the barrel such that the cutting of each port proceeds in the proximal to distal direction of the barrel from the outer surface to the inner surface, and wherein the resulting ports formed in the barrel are located so as to be radially symmetrical about the barrel.

* * * * *